US006478348B2

(12) United States Patent
Lahey

(10) Patent No.: US 6,478,348 B2
(45) Date of Patent: Nov. 12, 2002

(54) DOOR OR GATE RETAINER

(75) Inventor: Thomas James Lahey, Madoc (CA)

(73) Assignee: Lahey & Sharpe Enterprises and Investments Inc, Madoc (CA)

( * ) Notice: Subject to any disclaimer, the term of this patent is extended or adjusted under 35 U.S.C. 154(b) by 39 days.

(21) Appl. No.: 09/756,030

(22) Filed: Jan. 8, 2001

(65) Prior Publication Data

US 2002/0089191 A1 Jul. 11, 2002

(51) Int. Cl.[7] ..... E05C 17/36
(52) U.S. Cl. ..... 292/264
(58) Field of Search ..... 292/108, 246, 292/253, 285, 264, 341.17, 304, DIG. 13, DIG. 16, DIG. 29, 281, 286, 288–298, DIG. 32; 70/93; 24/598.7, 599.1, 265 CD, 132 AA, 132 R

(56) References Cited

U.S. PATENT DOCUMENTS

| | | | | |
|---|---|---|---|---|
| 1,799,265 A | | 4/1931 | Unkelbach | |
| 4,062,577 A | | 12/1977 | Butterfield | |
| 4,071,129 A | | 1/1978 | Crabb | |
| 4,269,439 A | | 5/1981 | Warwick | |
| 4,335,911 A | | 6/1982 | Taylor | |
| 4,422,678 A | * | 12/1983 | Tuckett et al. | 292/246 |
| 4,447,081 A | * | 5/1984 | Stottlemyre | 292/264 |
| 5,205,016 A | | 4/1993 | Kulot | |
| 5,273,326 A | * | 12/1993 | Kinkaide | 292/272 |
| 5,416,956 A | * | 5/1995 | Rubin | 24/199 |
| 5,582,446 A | | 12/1996 | Walker | |
| 5,655,798 A | | 8/1997 | Kaveney | |
| 5,664,304 A | * | 9/1997 | Tambornino | 24/370 |
| 5,832,572 A | * | 11/1998 | Norrby | 24/598.7 |
| 6,120,080 A | | 9/2000 | Hori | |
| 6,364,381 B1 | * | 4/2002 | Schmidt et al. | 248/304 |

* cited by examiner

*Primary Examiner*—Lynne H. Browne
*Assistant Examiner*—Dinesh N Melwani
(74) *Attorney, Agent, or Firm*—Richard J. Hicks

(57) ABSTRACT

A holdback device for holding a door or gate in either an open or closed position is described. A plate member is affixed to a support, adjacent the vertical side edge of the door in the selected open or closed position, and is provided with an upstanding finger member and a pivotally mounted bail intermediate the ends thereof. A chain is secured to the vertical side edge of the door and is passed upwardly through the bail and the end is slipped over the end of the finger member, which is then allowed to fall back to its rest position and thereby secures the door in the selected open or closed position.

10 Claims, 3 Drawing Sheets

DOOR OR GATE RETAINER

FIELD OF INVENTION

This invention relates to a holdback device for holding a door or gate in a selected open or closed position. More particularly the invention relates to a holdback device for holding doors of a highway cargo trailer in an open position.

BACKGROUND OF INVENTION

Highway trailers of conventional design are provided with hinged doors at various positions along the sides and at the rear of the trailer. These doors, which are generally pivotally mounted about vertical axes, are provided with handles and/or locking rods extending therefrom. It is also usual to provide means to secure the doors in an open position for loading and unloading operations and while the trailer is being manoeuvred to and from a loading dock or the like. Numerous devices have been described in the general and patent literature for this purpose, and, for the purposes of illustration only, attention is drawn to U.S. Pat. No. 4,269,439 issued May 26, 1981 and U.S. Pat. No. 5,273,326 issued Dec. 28, 1993. These devices generally require a mechanical bracket secured to the sidewall of the trailer and a latch mechanism secured to the hinged door. These devices generally protrude considerably from the sidewall and the latch mechanism usually fails to provide "fail-safe" locking with the result that the latch and bracket can become detached by vibration while travelling over rough terrain such as a potholed yard, or by reason of a strong wind gust. This may result in the door slamming shut causing damage to the door frame or to the door itself, or swinging in the wind and causing damage to adjacent vehicles. Major trucking companies report that the problem of insecure doors costs many of thousands of dollars in damage repairs each year. There is, therefore, a need for an improved locking device for securing vertically hung doors in the open position. While this invention will be described with particular reference to transport vehicles such as tractor-trailer or truck doors, it will be appreciated by those skilled in the art that the devices of the present invention find application to other vertically hung doors or gates, such as farm or factory gates which may be held in either an open or a closed position.

OBJECT OF INVENTION

It is an object of the present invention to provide a door or gate retaining device which incorporates a fail-safe mechanism to hold the door or gate in a selected open or closed position.

BRIEF SUMMARY OF INVENTION

By one aspect of this invention there is provided a retaining device for securing a planar member, swingable about a vertical axis between an open and a closed position between support members, comprising: (a) plate means, mountable on a selected said support member adjacent a vertical side edge of said planar member, including finger means integrally mounted, at a proximal end thereof, on said plate means, adjacent one end thereof, and extending perpendicularly therefrom and parallel thereto towards a distal end thereof adjacent a second end of said plate means, and bail means transversely pivotally mounted on said plate means intermediate the ends thereof for movement between a first position substantially planar with said plate means and a second position in abutting relation with said finger means intermediate the proximal and distal ends thereof; and (b) an inelastic, elongated flexible member having a proximal end attachable to said planar member adjacent said vertical side edge thereof and a distal end provided with ring means adapted for overlying sliding and removable engagement with the distal end of said finger means.

DETAILED DESCRIPTION OF PREFERRED EMBODIMENTS

Figure 1:
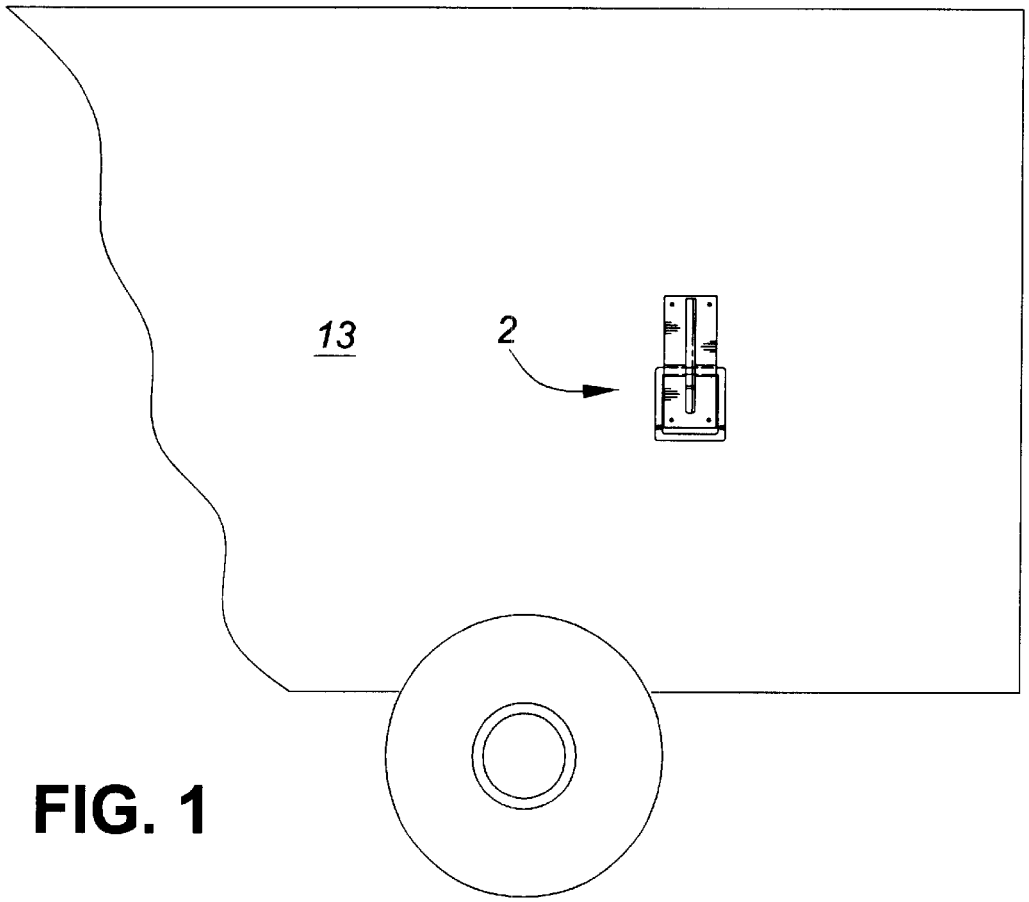
FIG. 1 is a front view of a vehicle door plate according to one aspect of the present invention as mounted on a side wall of a trailer.
Figure 2:
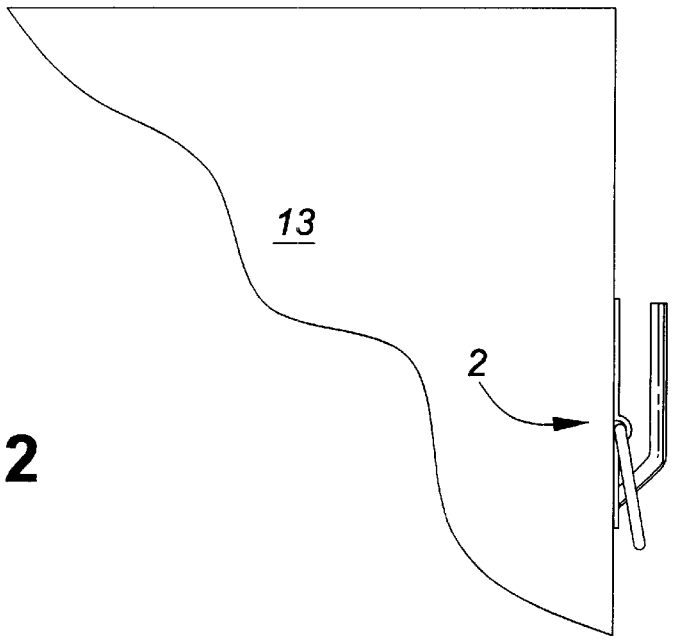
FIG. 2 is a side view of the plate of FIG. 1 with the loop in the lower position.
Figure 3:
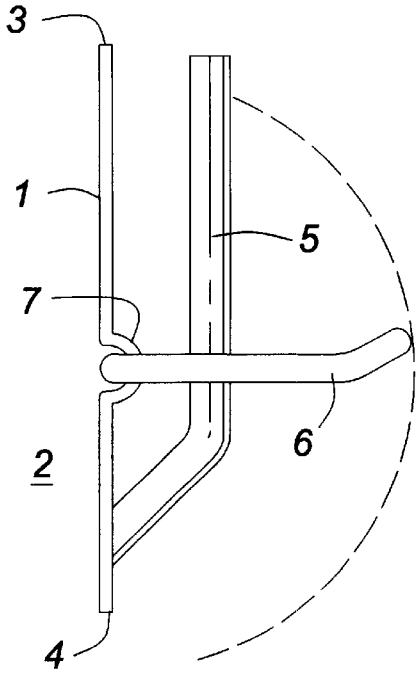
FIG. 3 is a side view of the plate of FIG. 1 with the loop in the upper position.

In FIGS. 1, 2 and 3 there is shown a back plate 1, mounted on the sidewall of a truck or trailer 2, adjacent the vertical side edge of the vehicle door in an open position, having an upper end 3 and a lower end 4. It will be appreciated that if it is desired to use the device to secure the door in the closed position, the plate 1 is mounted on a sidewall, or other door in the case of a double door arrangement or to a support pole, adjacent the vertical side edge of the door or gate in the closed position. A finger member 5 projects perpendicularly from and upwardly parallel to the plate 1 from a proximal position adjacent the lower end 4 to a distal position adjacent upper end 3. Intermediate ends 3 and 4 there is also provided a bail or loop member 6, pivotally mounted about a horizontal axis 7. Bail 6 can be raised from the rest position shown in FIG. 2, flush with the trailer sidewall 2 and planar to the plate 1, to an upper position, shown in FIG. 3, contacting the finger 5. Finger 5 is, however, somewhat longer than the height of bail 6 which cannot, therefore, pass to a fully vertical position. A short length of chain 8, or other elongated inelastic flexible member having a loop at the distal end thereof, is mounted, at the proximal end thereof, adjacent the edge of a vertically hung trailer door (not shown).

Figure 4:
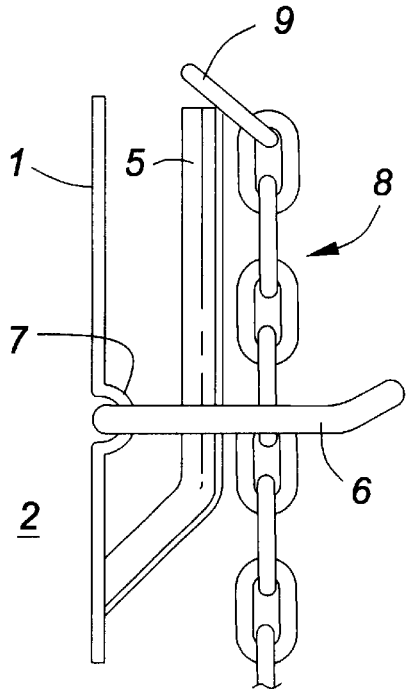
FIG. 4 is a side view of the plate of FIG. 1 with the loop intermediate the positions of FIGS. 2 and 3, showing the door chain being placed over the end of the finger.
Figure 5:
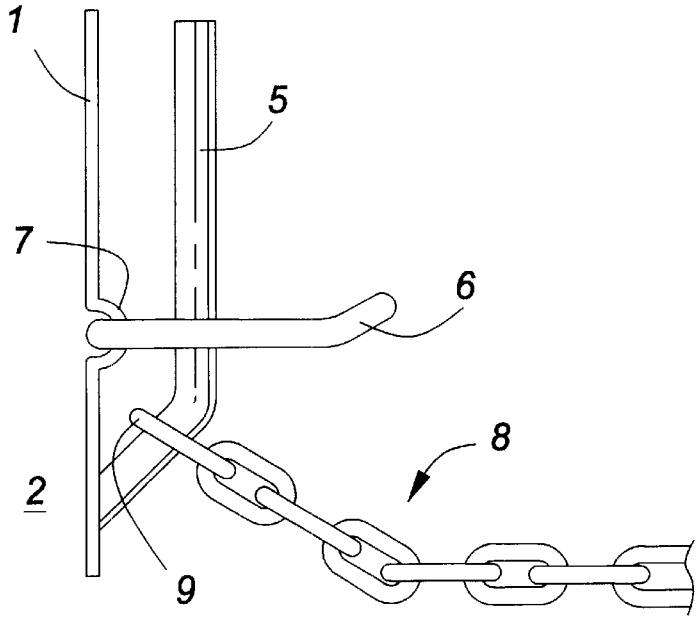
FIG. 5 is a side view of the plate of FIG. 1, similar to FIG. 4, but showing the door chain below the loop.
Figure 6:
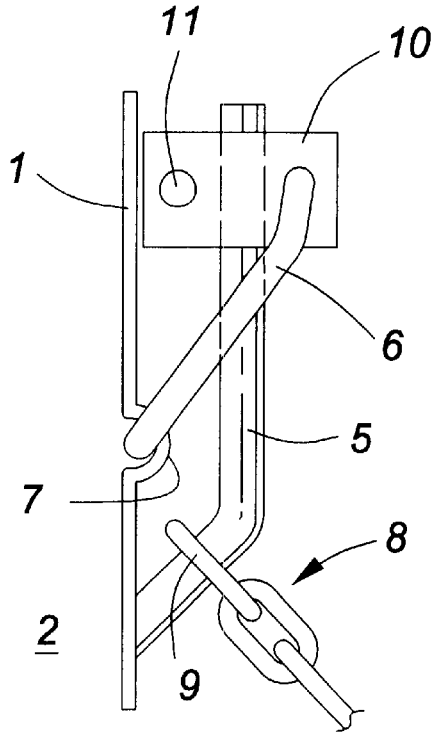
FIG. 6 is a side view of the plate of FIG. 1 incorporating a locking device.

In operation, the truck or trailer door is swung to the open position, bail 6 is raised to an intermediate, approximately horizontal, position as shown in FIG. 4 and the distal end of chain 8 is passed upwardly therethrough and the end link 9 thereof is placed over the distal end of finger 5. Link 9 is then allowed to slide down finger 5 and when it has passed through bail 6, the bail 6 is allowed to fall to the lower position shown in FIGS. 1 and 2 but positively trapping chain 8 behind it. It will be appreciated that neither vibration nor wind can separate the end of the chain 8 from the finger 5. It is, however, a simple matter to undo the lock, and release the door, by simply reversing the manual steps described above. In certain circumstances, such as with use as a farm gate, it may be desirable to lock the gate in a selected open or closed position. This may be accomplished by providing a U-shaped locking block 10, either rigidly or pivotally mounted on bail 6, as shown in FIG. 6, so that the arms of block 10 pass one on each side of finger 5. The bail of a conventional padlock (not shown) can then be passed through holes 11, thereby locking bail 6 in the position shown in FIG. 6 and positively preventing end 9 of chain 8 from being removed from finger 5.

Figure 7:
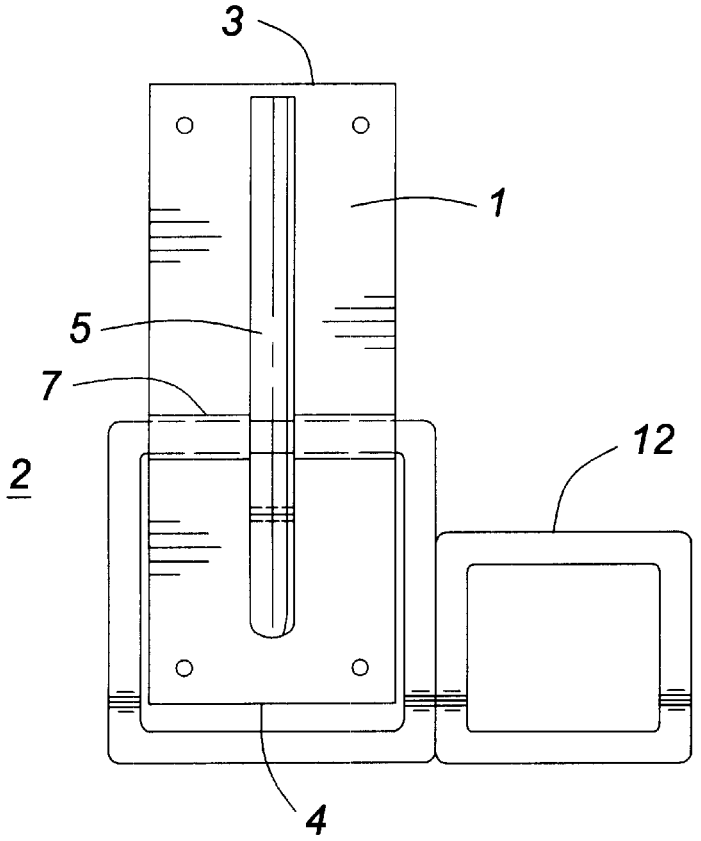
FIG. 7 is a side view of the plate of FIG. 1 incorporating a handle.

Many modifications and other embodiments within the scope of this invention will be obvious to those skilled in the art. For example, as shown in FIG. 7, a handle 12 may be provided on bail 6 to facilitate handling thereof and reduce the risk of injury to hands or fingers of an operator by pinching between bail 6 and chain 8. It will also be appreciated that when the device is used to secure farm or factory gates in either the open or closed position it may be necessary to provide U-clamps and/or spacer pieces to mount plate 1 to the appropriate square or circular support poles instead of the flat surface of a trailer sidewall as shown in FIG. 1.

I claim:

1. A retaining device for securing a planar member that is swingable about a vertical axis between an open and a closed position between vertical support members, comprising:

(a) a plate, mountable on one of said support members adjacent a vertical side edge of said planar member;

(b) a finger member integrally mounted, at a proximal end thereof, on said plate, adjacent a first, lower, end of said plate, so as to extend, when in operative position, perpendicularly outwardly from said plate and vertically upwardly, in a plane parallel to said plate, towards a distal end of said finger member adjacent a second, upper, end of said plate;

(c) a bail member transversely pivotally mounted on said plate intermediate the ends thereof, in a horizontal plane below the distal end of said finger member, for movement between a first position substantially planar with said plate and a second position in abutting relation with said finger member at a position below and spaced from the distal end of said finger member; and (d) an inelastic, elongated flexible member having a proximal end attachable to said planar member adjacent said vertical side edge thereof and a distal end provided with a ring adapted for overlying sliding and removable engagement over the distal end of said finger member and beneath said bail member so that, upon upward movement of said flexible member, said bail member engages said finger member in said second position in abutting relation therewith and prevents separation of said ring and said finger member.

2. A retaining device as claimed in claim 1 wherein said planar member is selected from the group consisting of a gate and transport vehicle door.

3. A retaining device as claimed in claim 2 wherein said transport vehicle door is a trailer door.

4. A retaining device as claimed in claim 3 wherein said support member is a trailer sidewall.

5. A retaining device as claimed in claim 2 wherein said planar member is a gate.

6. A retaining device as claimed in claim 5 wherein said support member is a support post.

7. A retaining device as claimed in claim 1 wherein said elongated flexible member is a chain.

8. A retaining device as claimed in claim 7 wherein said ring member is a link of said chain.

9. A retaining device as claimed in claim 1 including means to lock said bail in said second position.

10. A retaining device as claimed in claim 1 including a handle mounted on said bail.

* * * * *